United States Patent [19]

Duffy et al.

[11] Patent Number: 4,653,671

[45] Date of Patent: Mar. 31, 1987

[54] CONTAINER

[75] Inventors: Christene Duffy, 61 Pemberton Ave., Willowdale, Ontario, Canada, M2M 1Y2; Ivan Necakov, Concord, Canada

[73] Assignee: Christene Duffy, Willowdale, Canada

[21] Appl. No.: 732,075

[22] Filed: May 9, 1985

Related U.S. Application Data

[63] Continuation-in-part of Ser. No. 569,101, Jan. 9, 1984, abandoned.

[51] Int. Cl.[4] ..... B65D 35/56

[52] U.S. Cl. ..... 222/105; 222/561; 220/345; 215/322

[58] Field of Search ..... 222/92, 105, 465 R, 222/465 A, 470, 474, 498, 544, 559, 561, 566, 222/570–571, 572, 386.5; 220/306, 345, 346; 215/322

[56] References Cited

U.S. PATENT DOCUMENTS

| | | | |
|---|---|---|---|
| 2,274,562 | 2/1942 | Palmer | 222/559 |
| 2,388,050 | 10/1945 | Guarnaschelli | 215/322 |
| 2,604,232 | 7/1952 | Rublin | 222/570 X |
| 2,812,121 | 11/1957 | Sheets | 222/213 X |
| 2,820,578 | 1/1958 | Dickman | 222/470 X |
| 2,831,610 | 4/1958 | Dennie | 222/386.5 X |
| 2,872,081 | 2/1959 | Randall | 222/386.5 X |
| 3,255,932 | 6/1966 | Hunter et al. | 222/556 X |
| 3,527,373 | 9/1970 | Giraudet et al. | 220/345 |
| 3,606,962 | 9/1971 | Scholle | 222/530 X |
| 3,696,969 | 10/1972 | De Van et al. | 222/105 |
| 3,799,400 | 3/1974 | Fleury | 222/83.5 |
| 3,809,290 | 5/1974 | Schmit | 222/541 X |
| 3,817,430 | 6/1974 | Borin | 220/356 X |
| 3,840,140 | 10/1974 | Tisbo | 220/352 X |
| 4,247,020 | 1/1981 | Desjardins | 222/105 X |
| 4,446,987 | 5/1984 | White | 222/89 |

FOREIGN PATENT DOCUMENTS

| | | | |
|---|---|---|---|
| 2088837 | 6/1982 | United Kingdom | 222/153 |

*Primary Examiner*—Joseph J. Rolla
*Assistant Examiner*—Michael S. Huppert
*Attorney, Agent, or Firm*—Ridout & Maybee

[57] ABSTRACT

A jug for pouring liquids such as milk packaged in flexible rectangular pouches has a cross section and height such as to enclose the bag for its full height, the base of the jug being inclined so as to tilt the bag against a flattened front wall of the jug with a top corner projecting through a spout opening where it can be cut to form a pouring spout. The jug has a removable lid which is arched and has inturned side flanges which are pressed apart by out-turned side flanges at the top edges of the sides of the jug as the lid is pushed forward onto the jug so that the lid frictionally grips the jug. Rearward and downward pressure on the arch of the lid tends to force the inturned flanges apart and release the lid.

9 Claims, 6 Drawing Figures

CONTAINER

REFERENCE TO RELATED APPLICATION

This application is a continuation-in-part of copending application Ser. No. 569,101, filed Jan. 9, 1984 now abandoned.

FIELD OF THE INVENTION

This invention relates to jugs for pouring liquids packaged in flexible pouches, typically of a synthetic plastic film such as polyethylene film.

BACKGROUND OF THE INVENTION

In many countries, the packaging of liquids, especially milk, in rectangular flexible pouches has been widely adopted. Since the pounches have very little inherent stiffness, they must either be emptied into other containers prior to use of the contents, or used in conjunction with special jugs which support the pouch during pouring. A typical example of such a jug is shown in U.S. Pat. No. 3,606,962 issued Sept. 21, 1971 to Scholle. These jugs are cheap to produce and fairly satisfactory in operation. In order to obtain reasonably effective pouring performance, the jug is dimensioned so that the pouch projects above the top of the jug, the front of which has no conventional spout, but is instead shaped to support the material of the pouch adjacent a top corner which is cut to form a pouring spout. The exposed upper portion of the pouch is untidy and inelegant in appearance, and is easily inadvertently squeezed during cutting of the corner, causing unwanted spurting of the liquid contained in the pouch.

Simply increasing the height of the walls of the jug does not solve the problem because it increases the difficulty of cutting the top corner, and results in liquid from the resulting spout pouring between the pouch and the jug. Adding a lid, which may be domed, to the jug, enables the pouch to be hidden without such a large increase in wall height as would otherwise be necessary, but any such lid must be easy to apply and remove yet reasonably secure during pouring, and it has proved very difficult to ensure that a top corner of the pouch is properly presented at a spout of the jug, both to facilitate opening and to ensure satisfactory pouring after opening.

SUMMARY OF THE INVENTION

I have now developed a jug for pouring liquids from flexible pouches which substantially encloses the pouch, and can provide easy opening of the pouch and satisfactory pouring performance, with a lid which is easily applied and removed yet remain firmly in place during pouring.

The most difficult problem to overcome in producing a satisfactory product is to obtain proper presentation of a corner of a pouch at a pouring spout of a jug which encloses the pouch. We have now found that this problem can be overcome by providing the jug with a sloped base such as to cause the pouch to lean forward against a front wall of the jug and present an upper corner through an opening in the front wall.

According to the invention in a first aspect, a jug for pouring liquid contained in a flexible rectangular pouch has substantially vertical front, side and rear walls with a combined internal periphery similar to the girth of the filled pouch, the walls being of substantially the same height as the pouch, and the top edge of the front wall defining a downwardly extending recess to provide an opening for the passage of a top corner of the pouch, a handle extending from the outer surface of the rear wall, and a bottom wall connecting the front, side and rear walls to their adjacent lower edges, the bottom wall sloping downwardly from the rear wall to the front wall whereby to tilt the pouch against the front wall and present a top corner thereof at said opening. Preferably the side walls are generally divergent from the rear wall to the front wall and the front wall is substantially oblate so as to promote such presentation.

According to a second aspect of the invention, a jug for pouring liquid contained in a flexible rectangular pouch has substantially vertical outwardly bowed front, side and rear walls defining a generally ovoid cross section with its greatest width nearer the front than the rear of the jug and a combined internal periphery similar to the girth of a filled pouch, the walls being substantially the same height as the pouch, a handle extending outwardly from the rear wall and a spout formed at the top of the front wall, a bottom wall connecting the front, side and rear walls adjacent their bottom edges, and a removable lid of generally similar shape in plan to a horizontal cross section through the walls of the jug, the lid being resiliently flexible and having depending introverted flanges at its side edges, and the side walls having extraverted flanges at its side edges engageable above the intraverted flanges on the lid when the latter is pushed onto the jug from the rear, the rear edge of the lid having a depending flange engageable with the rear wall of the jug to limit forward movement of the lid, and the maximum distance between the outer extremities of the extraverted flanges being such as to tend to force apart the depending flanges of the lid as the latter is pushed onto the jug whereby to cause the lid to grip the jug.

Preferably the lid is domed, and preferably also portions of the front wall to either side of the spout are bowed slightly upwardly to increase frictional engagement with front edge portions of the lid.

Further features of the invention will become apparent from the following description of a preferred embodiment thereof with reference to the accompanying drawings.

IN THE DRAWINGS

DESCRIPTION OF THE PREFERRED EMBODIMENTS

Figure 5:
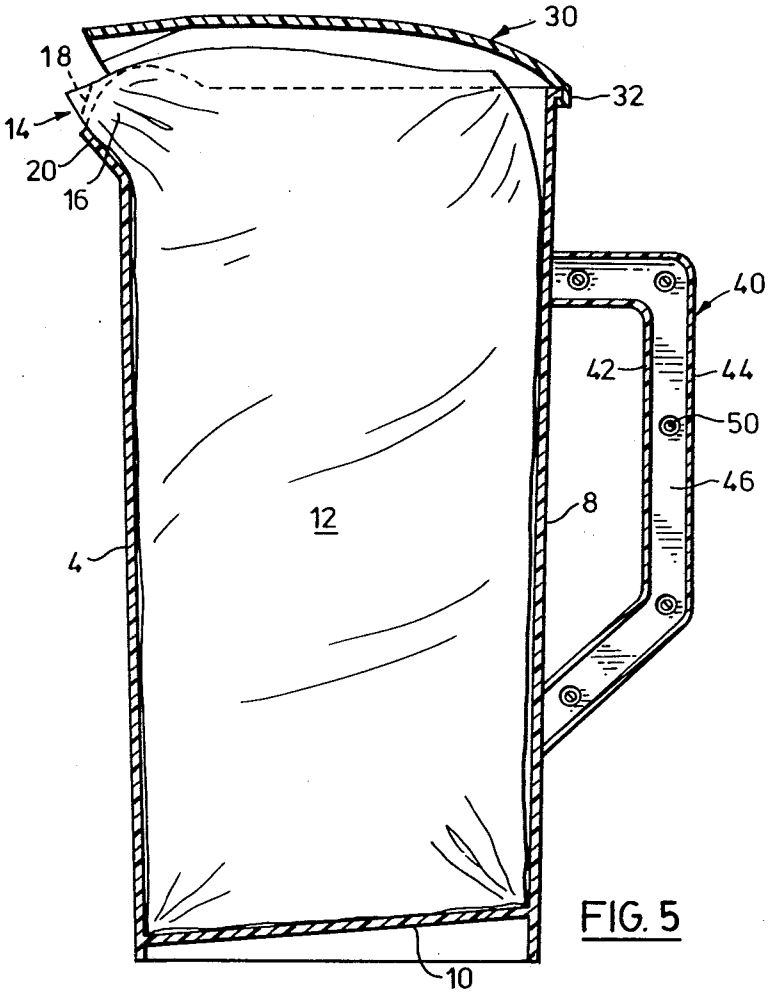
FIG. 5 is a vertical section through the jug when in use.

The jug shown in the drawings has a main body 2 moulded in one piece from a fairly rigid synthetic plastics material, and has outwardly bowed front, side and rear vertical walls 4, 6 and 8 joined by smoothly radiused corners to provide a cross section which is generally ovoid, but substantially oblated at the front and rear walls and with the side walls generally diverging from the rear towards the front. The vertical walls are connected adjacent their bottom edges by a bottom wall 10 which slopes downwardly from the rear to the front walls so that the angle included between the bottom wall and the front wall is slightly less than 90° . The combined internal periphery of the internal walls is approximately the same as the girth of a liquid filled pouch 12 (see FIG. 5) to be received in the jug, but preferably slightly greater so as to assist easy insertion of a filled pouch. The pouch is an oblong rectangular envelope of flexible material, usually synthetic plastic film, which assumes a cushion shape when filled with a liquid such as milk. The height of the vertical walls is approximately the same as the length of a filled pouch, so that the latter just fits within the jug when inserted therein. Obviously different sizes of jugs are required for different sizes of pouch, but since the latter are generally of a standard capacity such as 1.33 liters 1.5 U.S. quarts), this will not normally be a problem.

The rear wall 8 is formed with an outwardly projecting handle 40. In order to save material whilst providing a generously dimensioned handle, the handle is moulded with an H section having inner and outer flanges 42, 44, joined by a web 46. Filler pieces 48 are joined together through apertures in the web by spigot and socket connections 50.

The front wall 4 of the jug has a recess 14 extending downwardly from the top margin of its front wall to form an opening through which a corner 16 of the pouch 12 can project into a position where it can be cut (as shown by broken line 18) to provide a pouring spout. In order to provide improved support for the pouch adjacent the corner, the side and bottom margins of the opening are inclined outwardly to form a short spout 20, which also renders the jug functional to pour liquids when a pouch 12 is not being used. The front wall 4 is bowed upwardly in zones 22 to either side of the spout 20, for reasons discussed further below.

Figure 2:
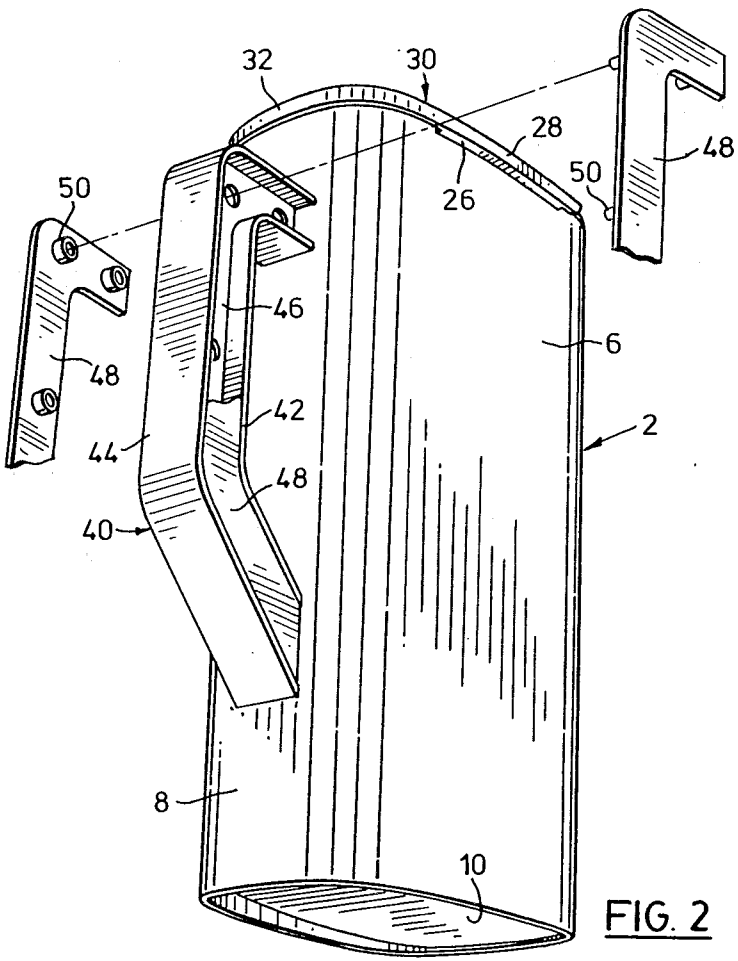
FIGS. 1, 2, 3 and 4 are respectively a perspective view from in front and above, a perspective view from behind and below, a front elevation and a plan view of a jug in accordance with the invention.
Figure 1:
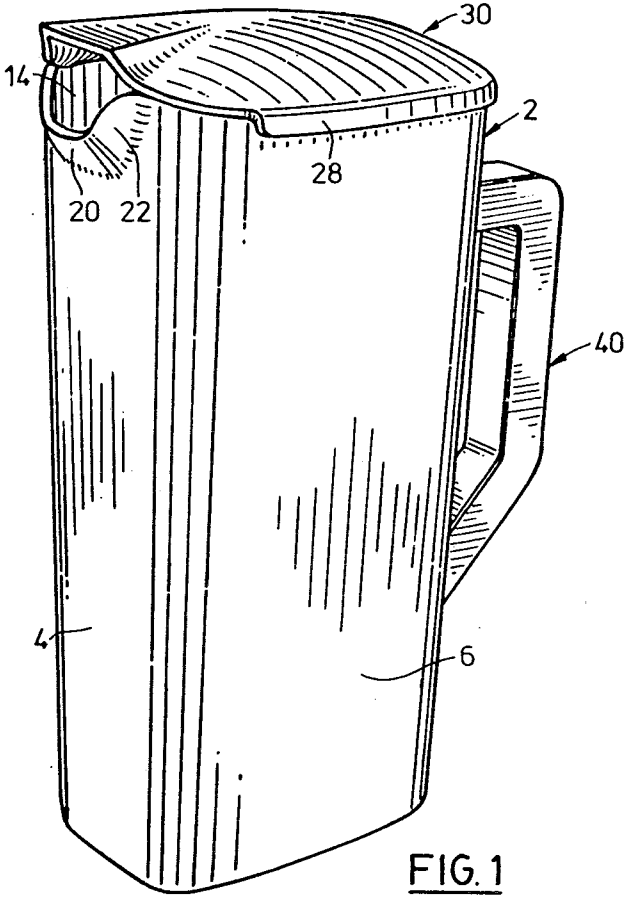
Figure 3:
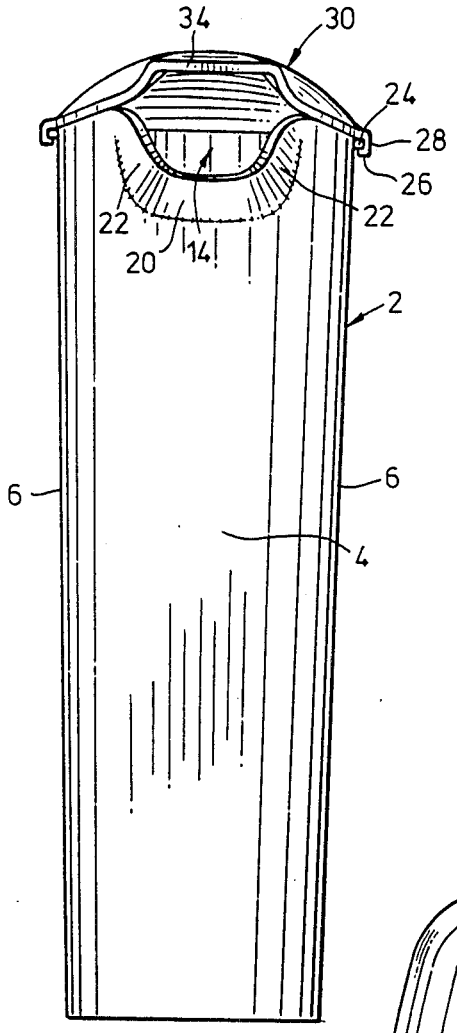
Figure 4:
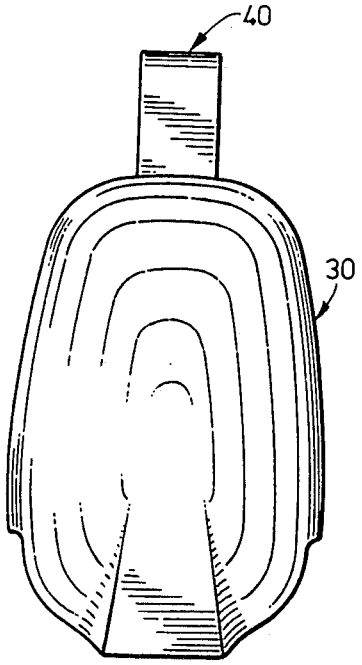
Figure 6:
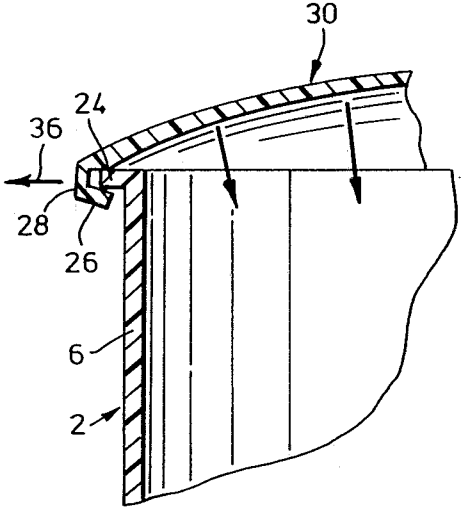
FIG. 6 is a fragmentary tranverse vertical section on an enlarged scale through part of a lid of the jug and an adjacent wall portion.

Each side wall 6 is provided at its top edge with an extraverted flange 24 which engages beneath a tapered intraverted portion 26 of a depending flange 28 at each side edge of a lid 30. The shape of the lid in plan is similar to the horizontal cross section of the jug. It is of generally domed form and moulded from flexible resilient synthetic plastic. It is engaged with the top edges of the walls of the jug 2 by sliding it on from the rear so that the tapered flange portions 26 engage beneath the flanges 24. The spacing of the flanges 26 is such that they are forced apart by the flanges 24 as shown by the arrow 36 in FIG. 6. The forward movement of the lid onto the jug is limited by a flange 32 at the rear of the lid and continuous with the flanges 28. There is no depending flange at the front of the lid, which is arched upwardly at 34 over the spout 20. As the lid is pushed forward, the front edges of lid ride upwardly over the zones 22, whilst the forces 36 acting on the flanges 28 tend to bow the front edge of the lid downwardly as shown by arrows 38, against the zones 22.

In use, the lid 30 is removed from the jug 2, and an unopened pouch 12 of liquid is lowered into the interior of the jug with its corners facing front and rear. As the pouch comes to rest on the inclined bottom wall 10, it leans forward against the oblated front wall 4 which flattens the front of the pouch, the leaning and flattening both contributing to presenting the corner 16 of the pouch through the opening formed by the recess 14. The lid 30 is then pushed on from the rear, and is held firmly in place by frictional engagement between the flanges 24 and 28, and between the lid and the zones 22. The corner 16 is cut off to provide an actual pouring spout, and the contents of the pouch may then be poured as desired.

When the lid is to be removed, downward and rearward finger pressure on the arch of the lid, particularly in the region 34 which provides a natural fingerhold, will tend to spread apart the flanges 28 and release the lid for rearward movement and removal. With this configuration it is possible to provide a lid which remains securely in place during normal use, yet requires remarkably slight pressure to release it. As the front edges of the lid slide off the zones 22, the rear of lid tilts upwardly into the palm of the hand, thus further facilitating easy removal. The arching of the lid not only facilitates its application and removal, but also provides a desirable tolerance to accommodate bags of different heights; it has been found that there is a significant variation in height between bags from different sources.

We claim:

1. A jug for pouring liquid contained in a flexible rectangular pouch, said jug having substantially vertical front, side and rear walls with a combined internal periphery similar to the girth of the filled pouch, the walls being of substantially the same height as the pouch, and the top edge of the front wall defining a downwardly extending recess to provide an opening adjacent a top corner of the pouch when dropped into the jug, a handle extending from the surface of the rear wall, and a bottom wall connecting the front, side and rear walls to their adjacent lower edges, the bottom wall sloping downwardly from the rear wall to the front wall so that the included angle between the front wall and the base is slightly less than 90°, whereby to tilt the pouch against the front wall and present said top corner through said opening to form a pouring spout.

2. A jug according to claim 1, wherein the side walls are generally divergent from the rear wall to the front wall and the front wall is substantially oblate so as to promote presentation of said top corner of the pouch at said opening.

3. A jug according to claim 2, including a removable lid which is arched and has inturned side flanges, the top edges of the side walls of the jug having out-turned flanges spaced to press apart the side flanges of the lid as the latter is pushed forward onto the top of the jug, whereby the lid frictionally grips the jug and rearward and downward pressure on the arch of the lid moves the flanges thereon apart and the lid rearward off the jug.

4. A jug for pouring liquid contained in a flexible rectangular pouch having substantially vertical outwardly bowed front, side and rear walls defining a generally ovoid cross section with its greatest width nearer the front than the rear of the jug and a combined internal periphery similar to the girth of a filled pouch, the walls being substantially the same height as the pouch, a handle extending outwardly from the rear wall and a spout formed at the top of the front wall, a bottom wall connecting the front, side and rear walls adjacent their bottom edges, and a removable lid of generally similar shape in plan to a horizontal cross section through the walls of the jug, the lid being resiliently flexible and having depending intraverted flanges at its side edges, and the side walls having extraverted flanges at its side edges engageable above the intraverted flanges on the lid when the latter is pushed onto the jug from the rear, the rear edge of the lid having a depending flange engageable with the rear wall of the jug to limit forward movement of the lid, and the maximum distance between the outer extremities of the extraverted flanges being such as to tend to force apart the depending flanges of the lid as the latter is pushed onto the jug whereby to cause the lid to grip the jug.

5. A jug according to claim 4, wherein the lid is of generally domed form, with an arched portion at the front.

6. A jug according to claim 5, wherein portions of the front wall to either side of the spout are bowed upwardly so as to press up against the lid when the latter is fully engaged.

7. A jug according to claim 4, wherein the bottom wall of the jug is inclined downwardly from the rear wall to the front wall so as to tip a pouch placed in the jug against the front wall and present a top corner of the pouch through the spout.

8. A jug according to claim 7, wherein the ovoid cross section is substantially oblate at the front wall.

9. A jug according to claim 4, wherein the handle is of H-section with filler pieces secured in each cavity of the H-section by spigot and socket joint extending through apertures in a web portion of the H-section.

* * * * *